US009850842B2

(12) United States Patent
Christ et al.

(10) Patent No.: US 9,850,842 B2
(45) Date of Patent: Dec. 26, 2017

(54) CONTROLLER FOR A COMMON-RAIL INJECTION SYSTEM

(71) Applicant: Liebherr Machines Bulle SA, Bulle (CH)

(72) Inventors: Konrad Christ, Bulle (CH); Francois Masson, Villars-sur-Glane (CH); Richard Pirkl, Bulle (CH)

(73) Assignee: Liebherr Machines Bulle SA, Bulle (CH)

( * ) Notice: Subject to any disclaimer, the term of this patent is extended or adjusted under 35 U.S.C. 154(b) by 624 days.

(21) Appl. No.: 14/256,638

(22) Filed: Apr. 18, 2014

(65) Prior Publication Data

US 2014/0311453 A1 Oct. 23, 2014

(30) Foreign Application Priority Data

Apr. 19, 2013 (CH) ..... 802/13

(51) Int. Cl.
*F02D 41/24* (2006.01)
*F02D 41/38* (2006.01)
*F02D 41/14* (2006.01)

(52) U.S. Cl.
CPC ..... *F02D 41/2467* (2013.01); *F02D 41/1402* (2013.01); *F02D 41/3809* (2013.01); *F02D 41/3836* (2013.01)

(58) Field of Classification Search
CPC ..... F02D 41/3809; F02D 41/2467; F02D 41/1402; F02D 41/3836; F02D 41/247;
(Continued)

(56) References Cited

U.S. PATENT DOCUMENTS 5,150,836 A * 9/1992 McKay ..... F02D 41/40 239/411
5,176,122 A 1/1993 Ito
(Continued)

FOREIGN PATENT DOCUMENTS

DE 691 12 355 T2 2/1996
DE 299 04 840 U1 7/1999
(Continued)

OTHER PUBLICATIONS

European Search Report dated Sep. 26, 2014 with partial English translation (Six (6) pages).
(Continued)

*Primary Examiner* — Sizo Vilakazi
*Assistant Examiner* — Brian Kirby
(74) *Attorney, Agent, or Firm* — Crowell & Moring LLP

(57) ABSTRACT

A controller for a common-rail injection system includes a plurality of fuel injectors, a common fuel supply line for the fuel injectors, a high-pressure pump for supplying the common fuel supply line with fuel, and a pressure sensor for determining the pressure in the common fuel supply line. A determination unit evaluates data of the pressure sensor and, from the pressure drop caused by an injection in the common fuel supply line, determines the fuel quantity actually injected during this injection or a value derived therefrom. An adaption unit uses the results of the determination unit in order to adapt the actuation of the fuel injectors. The determination unit carries out at least one test injection, and the actually injected fuel quantity or a value derived therefrom is effected by way of the test injection or injections.

20 Claims, 4 Drawing Sheets

(58) Field of Classification Search
CPC ..... F02D 41/221; F02D 41/402; F02D 2041/224; F02D 41/2438; F02D 2200/0614; F02D 41/2432; F02D 19/061; F02D 2200/0618; F02D 41/405; F02D 2250/04; Y02T 10/44; F02M 65/00; F02M 55/025
USPC ..... 123/456, 299, 447; 701/103, 104; 73/114.51, 114.45
See application file for complete search history.

(56) References Cited

U.S. PATENT DOCUMENTS 5,535,621 A * 7/1996 Glidewell ..... F02D 41/221 123/478
5,633,458 A * 5/1997 Pauli ..... F02D 41/22 701/105
6,053,150 A 4/2000 Takahashi et al.
6,142,121 A * 11/2000 Nishimura ..... F02D 41/008 123/447
6,244,241 B1 6/2001 Mamiya et al.
6,349,702 B1 * 2/2002 Nishiyama ..... F02D 41/3836 123/447
6,705,294 B2 * 3/2004 Shinogle ..... F02D 41/2467 123/486
6,729,297 B2 * 5/2004 Futonagane ..... F02D 41/3836 123/294
6,964,261 B2 * 11/2005 Warne ..... F02D 41/123 123/436
7,437,234 B2 * 10/2008 Halleberg ..... F02D 41/2438 123/447
7,657,361 B2 * 2/2010 Inoue ..... F02D 41/1498 123/436
7,677,092 B2 * 3/2010 Ishizuka ..... F02D 41/1498 73/114.45
7,841,319 B2 * 11/2010 Thomas ..... F02D 41/2438 123/478
7,913,666 B2 * 3/2011 Achleitner ..... F02D 41/0087 123/447
8,554,454 B2 * 10/2013 Hemmerlein ..... F02M 63/0225 123/479
2004/0134268 A1 * 7/2004 Tuken ..... F02D 41/2496 73/114.39
2005/0199221 A1 * 9/2005 Dietl ..... F02D 41/062 123/490
2006/0107936 A1 5/2006 Mazet
2008/0276906 A1 * 11/2008 Thomas ..... F02D 41/2438 123/457
2008/0308065 A1 * 12/2008 Imai ..... F02D 41/1497 123/299
2009/0045267 A1 * 2/2009 Sutter ..... F02D 41/2096 239/102.2
2009/0164086 A1 * 6/2009 Geveci ..... F02D 41/2438 701/102
2009/0164094 A1 * 6/2009 Geveci ..... F02D 41/0087 701/103
2009/0177366 A1 * 7/2009 Achleitner ..... F02D 41/0087 701/103
2009/0299608 A1 * 12/2009 Loeffler ..... F02D 35/023 701/104
2010/0030454 A1 * 2/2010 Olbrich ..... F02D 41/2438 701/104
2010/0251809 A1 * 10/2010 Migueis ..... F02D 41/22 73/114.51
2011/0132321 A1 * 6/2011 Pursifull ..... F02D 41/0027 123/299
2011/0313639 A1 * 12/2011 Hemmerlein ..... F02M 63/0225 701/103
2012/0118053 A1 * 5/2012 Serra ..... F02D 41/221 73/114.51
2012/0150417 A1 * 6/2012 Massaro ..... F02D 41/222 701/104
2012/0283934 A1 * 11/2012 Topp ..... F02D 41/22 701/104

FOREIGN PATENT DOCUMENTS

DE 10 2006 023 468 B3 9/2007
DE 10 2007 028 900 A1 12/2008
DE 102007028900 A1 * 12/2008 ..... F02D 41/22
DE 10 2008 041 522 A1 4/2009
DE 197 26 100 B4 2/2011
EP 0 894 965 A1 2/1999
EP 0 947 684 A2 10/1999
EP 0 947 686 A2 10/1999
EP 1 424 480 A1 6/2004
EP 2 053 226 A2 4/2009
EP 2 455 605 A1 5/2012
FR 2 857 700 A1 1/2005

OTHER PUBLICATIONS

Swiss language Search Report dated Jul. 15, 2013 (Four (4) pages).

* cited by examiner

CONTROLLER FOR A COMMON-RAIL INJECTION SYSTEM

The present application claims priority to Swiss patent application 00802/13, filed Apr. 19, 2013, the entire disclosure of which is incorporated herein by reference.

BACKGROUND OF THE INVENTION

Field of the Invention

The present invention relates to a controller for a common-rail injection system which includes a plurality of fuel injectors, a common fuel supply line for the fuel injectors, a high-pressure pump for supplying the common fuel supply line with fuel, and a pressure sensor for determining the pressure in the common fuel supply line. In particular, this invention concerns a controller of a common-rail injection system of a diesel engine.

In the actuation of an engine, the precise dosage of the injected fuel quantity plays an essential role with regard to the subsequent combustion and the exhaust gases generated thereby. Due to production-related component variances of the fuel injectors and aging phenomena during the engine operation, the same must therefore be calibrated while the engine is running. This means that deviations or drifts in the actually injected fuel quantity must be detected, quantified and compensated by a corresponding adaptation of the injector actuation.

Description of Related Art

In this respect it is known for example from the German document DE19726100A1, European publication EP894965A1, and German document DE69112355T2 to calculate target injection quantities with reference to the engine operating condition and to perform the actuation of the fuel injectors on the basis of these target injection quantities. During the engine operation, the pressure drop caused by the injections in the common fuel supply line of the common-rail injection system is evaluated and the fuel quantity actually injected during the injections is determined therefrom. There is formed the difference of the pressure before the injection performed with a target injection quantity and after the injection, and thus the pressure drop caused by the injection is determined, by means of which in turn the actually injected fuel quantity is determined. By means of the results for preceding fuel injections, the actuation of the fuel injectors is adapted for succeeding fuel injections.

SUMMARY OF THE INVENTION

It is one object of the present invention to further improve such system based on the pressure in the common fuel supply line.

According to the invention, this object is achieved by a controller for a common-rail injection system which includes a plurality of fuel injectors, a common fuel supply line for the fuel injectors, a high-pressure pump for supplying the common fuel supply line with fuel, and a pressure sensor for determining the pressure in the common fuel supply line. The controller comprises a determination unit which evaluates data of the pressure sensor and from the pressure drop caused by an injection in the common fuel supply line determines the fuel quantity actually injected during this injection or a value derived therefrom. The controller furthermore comprises an adaption unit which uses the results of the determination unit, in order to adapt the actuation of the fuel injectors. According to the invention it is provided that the determination unit carries out at least one test injection, by means of which the determination of the actually injected fuel quantity or a value derived therefrom is effected.

As opposed to the prior art, it hence is not the fuel injections made during the normal operation of the injection system which are used for this determination, but specific test injections. This allows a higher flexibility and higher accuracy in the determination of the adaption of the injection.

In a preferred embodiment, the determination unit determines a reference measurement signal of the pressure sensor without test injection and a test measurement signal of the pressure sensor when the test injection has been made. In this way, a considerably increased accuracy can be achieved as compared to methods known from the prior art, which operate without reference signal.

This procedure also only is possible because, instead of an injection used during the normal engine operation, a test injection is used, which hence also can be omitted again without disturbing the engine operation in succeeding engine cycles.

Advantageously, the determination unit for determining the pressure drop caused by an injection forms the difference between the reference measurement signal and the test measurement signal.

It can be provided that the determination unit determines the reference measurement signal and the test measurement signal in the same time interval with respect to the engine cycle. It can furthermore be provided that the determination unit determines the reference measurement signal and the test measurement signal under injection and/or engine operating conditions, which are identical except for the test injection. By forming the difference between reference measurement signal and test measurement signal, the influence of the test injection on the pressure signal thereby can be determined exactly.

According to a preferred embodiment of the present invention, the determination unit carries out several test injections and forms a mean value for determining the actually injected fuel quantity or a value derived therefrom. The accuracy of the determination can be increased thereby.

Preferably, the determination unit performs the several test injections in the same time interval with respect to the engine cycle and/or under identical injection and/or engine operating conditions. Furthermore preferably, the determination unit can perform the several test injections with identical durations of actuation of the fuel injector and/or injection quantities for the respective test injections. In particular, the actuation of the individual test injections can be effected with identical actuation signals for the fuel injector.

In a particularly preferred embodiment, the determination unit determines both the test measurement signal and the reference measurement signal several times.

According to a preferred embodiment, the determination unit performs the at least one test injection in a specified time interval of the engine cycle and/or with a specified duration of actuation and/or with a specified injection quantity of the fuel injector. In particular, a specified actuation signal can be used.

In a possible embodiment, the specified time interval and/or the specified duration of actuation and/or injection quantity and in particular the specified actuation signal can be stored in the controller.

Preferably, the specified time interval and/or the specified duration of actuation and/or injection quantity of the fuel injector, and in particular the specified actuation signal, are independent of the injection time and/or injection quantity of the injection desired for the normal engine operation. In this way, a test routine specifically adapted to the adaption can be used, whereby a correspondingly better reproducibility and increased accuracy is achieved.

The determination performed by the determination unit can be carried out during the normal operation of the engine, in that test injections are made in addition to the normal injections for the engine operation.

In particular, the test injection can be a pre-injection or post-injection effected before or after the main injection. Since the pressure signal used for determining the fuel quantity injected during the test injection is influenced both by the main injections and by the test injections, a certain temporal distance between main and test injection is necessary. Preferably, a test injection is effected with a predetermined temporal distance to the preceding and the succeeding main injection.

To influence the engine operation as little as possible and to avoid too long an injection time, which would lead to a large temporal proximity between main and test injection, the injection quantity of the test injection preferably is chosen below 100 mg, furthermore preferably below 50 mg.

Furthermore, the injection quantity of a test injection preferably is chosen above 2 mg, furthermore preferably above 4 mg, since with even smaller injection quantities the pressure drop is so small that the corresponding signal hardly can be distinguished from interference signals.

A typical test injection quantity for example can be 20 mg.

Advantageously, the controller according to the invention includes an activation unit which prompts the determination unit to start the evaluation operation and initiate a test routine in which at least one test injection is made. The activation of the determination unit for example can be effected in specified intervals.

A preferred embodiment of the controller according to the invention comprises a monitoring unit for monitoring the engine operation, which is connected with the determination unit such that the determination of the actually injected fuel quantity or the value derived therefrom is carried out by the determination unit in operating conditions of the engine suitable for the determination. In particular, transient operating conditions of the engine should be avoided, since the same can reduce the accuracy of the determination.

For example, it can be provided that the determination is made at a constant target pressure in the common fuel supply line, and/or at a constant temperature in the common fuel supply line and/or at a constant speed of the engine, and/or at constant fuel injection quantities for the normal engine operation. This is advantageous in particular when beside the test measurement signal a reference measurement signal is determined, as the same necessarily must be determined in another engine cycle, and/or when several measurements and in particular several test injections are carried out, so that changes of the operating conditions would have an impact on the measurement.

Furthermore, the initiation of the determination of the actually injected fuel quantity or a value derived therefrom can be effected by the determination unit in response to an inquiry as to whether the speed of the engine operates below a certain speed threshold.

In particular, the monitoring unit can monitor the speed of the engine and only initiate a test routine, in which at least one test injection is made, when the speed lies below a certain speed threshold. Since the speed and the cycle length are inversely proportional to each other, the small speed has the advantage that between two main injections of the normal engine operation a correspondingly long time interval is left, in which the test injection can be carried out and a corresponding pressure measurement can be carried out. This allows to maintain the distance between main and test injection important for the accuracy of the measurement.

Particularly preferably, the determination is effected in the idle mode of the internal combustion engine.

In a preferred embodiment, the determination unit determines the pressure drop caused by the injection with reference to at least one measurement value determined within a specified evaluation interval. The evaluation interval in particular can be a specified time interval or one or more specified points in time. According to the invention, at least one measurement time or at least one measurement interval hence is defined, in which the measurement of the pressure is performed for determining the pressure drop due to the test injection.

Advantageously, the evaluation interval is defined with respect to the time of the actuation of the fuel injector for the test injection. Since according to the invention this is a test injection with a specified duration and form, the determination of the measurement time does not require monitoring of the pressure signal for a suitable point in time and in particular for a decline of the pressure level. Rather, such evaluation interval or such measurement time for example can be determined in advance by an experiment in dependence on the time of the actuation of the fuel injector for the test injection. Advantageously, the evaluation interval is stored in the controller. In particular, the actuation signal of the fuel injector for triggering the test injection can trigger a measurement pick-up over a specified period, wherein the evaluation interval has a specified temporal distance to the start of the measurement pick-up.

Advantageously, the evaluation interval is located after the end of the actuation of the fuel injector for the test injection. Advantageously, at least one measurement value is measured, after the actuation of the fuel injector for the test injection has been terminated. Advantageously, a certain distance to the time of the end of the actuation of the fuel injector is provided, in order to account for a delay between the actuation of the fuel injector and the actual pressure drop.

Furthermore, the evaluation interval can be chosen such that the measurement signal as closely as possible corresponds to the static part of the pressure drop, which has been caused by fuel flowing off from the common-rail system due to the test injection.

In a possible embodiment, the evaluation interval can be chosen such that it only starts after the first attenuated half-oscillation of the pressure signal caused by the test injection. Advantageously, the evaluation interval can be chosen such that it only starts after the first attenuated full oscillation of the pressure signal caused by the test injection.

In a further preferred embodiment of the present invention, several measurement values are averaged within the evaluation interval, in order to compensate fluctuations in the signal.

Furthermore, the test injection preferably is effected at a point in time which is located after the first attenuated half-oscillation caused by a main injection and/or the operation of the high-pressure pump. This takes into account that the operation of the high-pressure pump and the main injections also dynamically influence the pressure signal. This influence should have subsided as far as possible at the beginning of the test injection. The test injection preferably is effected at a point in time which is located after the first attenuated full oscillation of the pressure signal caused by a main injection and/or the operation of the high-pressure pump.

As already described above, the difference between a test measurement signal and a reference measurement signal particularly preferably is employed for determining the pressure drop. Advantageously, the reference measurement signal also is determined over the specified evaluation interval. Advantageously, the measurement pick-up likewise is started in dependence on the point in time within the engine cycle, at which otherwise the test injection would be made. Furthermore, the evaluation interval also advantageously is defined as described above in dependence on this point in time. For determining the reference measurement signal, a very short actuation pulse can be transmitted to the fuel injector, which is not sufficient to open the same, but initiates the measurement pick-up like in the determination of the test measurement signal.

By using a reference signal, superpositions of the pressure profile caused by the test injection with the pressure profiles caused by other events such as the operation of the high-pressure pump or a main injection can again be eliminated.

Alternatively, however, it would also be conceivable to form the difference between a value of the test measurement signal at the above-described measurement time or in the above-described evaluation interval and a measurement value determined before the injection, in order to determine the pressure drop.

In a preferred embodiment, the determination and adaption is effected individually for each fuel injector. Component tolerances as well as individual drifts of the properties of the fuel injectors thereby can be taken into account.

According to a further preferred embodiment, the determination and adaption is effected by the determination unit for several different operating points of the injection system and/or the engine. In particular, the determination can be effected for several different pressures in the common pressure line. Alternatively, however, it is conceivable to carry out the test injections at only one pressure value and extrapolate the same for other pressure values.

According to a further preferred embodiment, the determination and adaption is effected by the determination unit for several different durations of actuation and/or injection quantities of the fuel injector during the test injection.

The injection quantity of the test injections preferably can lie between 2 mg and 80 mg, furthermore preferably between 5 mg and 50 mg. Furthermore, it can be provided that the test injections extend over a range of more than 10 mg, preferably of more than 20 mg, and furthermore of more than 30 mg.

Furthermore, the number of the different durations of actuation and/or injection quantities preferably lies between 2 and 20, furthermore preferably between 4 and 10.

Advantageously, the determination unit therefore comprises a test routine which carries out several different test injections and/or several test injections under different operating conditions of the pressure line and/or the engine. It thereby is possible to correct the map of the respective fuel injectors not only globally by a single correction factor, but separately for different input values.

In particular, the adaption unit can determine a correction factor which is dependent on one or more input values of the map which is employed for the actuation of the respective fuel injectors. In particular, the correction factor can depend on the pressure in the common pressure line and/or on the desired duration of actuation and/or injection quantity of the fuel injector.

In a further preferred embodiment of the present invention, the determination of the actually injected fuel quantity or a value derived therefrom is effected by the determination unit in coordination with the actuation of the high-pressure pump. In particular, the coordination is effected such that between the start of a test injection and the end of the associated measurement phase no operation is effected in the high-pressure pump. Advantageously, no operation of the high-pressure pump is effected either during the determination of a reference measurement signal. Furthermore, the time of the test injections preferably is chosen such that a certain time interval lies between the end of the operation of the high-pressure pump and the start of the test injection.

Such coordination on the one hand can be effected in that the determination unit and the actuation circuit of the high-pressure pump exchange data. Alternatively, the actuation circuit also can be designed such that the pressure drop caused by the test injection in the common pressure line does not lead to a start of the high-pressure pump within the associated measurement phase. In particular, the actuation circuit of the high-pressure pump can react to a pressure drop with a certain delay which is longer than the measurement phase. Furthermore alternatively, the test injections and the operation of the high-pressure pump can be effected at specified, sufficiently spaced points in time, in particular at specified angles of rotation of the crankshaft spaced from each other.

In a possible embodiment of the present invention, the operation of the high-pressure pump (2) and/or the initiation of the test injection within an engine cycle each are effected at specified points in time and/or crankshaft angles.

In an operating phase in which test injections are made, the operation of the high-pressure pump can be shifted towards early or towards late, wherein the test injection is effected in the prolonged interval between the operation of the high-pressure pump and the main injection or in the prolonged interval between the main injection and the operation of the high-pressure pump.

The operation of the high-pressure pump also can be effected simultaneously with the main injection, so that for the test injection a maximally large period is available.

Furthermore, it can be provided that in an operating phase in which test injections are made, individual main injections and/or operating phases of the high-pressure pump are omitted. The period available for the test injection thereby is expanded once again.

The present invention furthermore comprises a common-rail injection system which includes a plurality of fuel injectors, a common pressure line for the fuel injectors, a high-pressure pump for supplying the common pressure line with fuel, and a pressure sensor for determining the pressure in the common pressure line. The common-rail injection system according to the invention furthermore includes a controller as it has been described above in detail.

Furthermore, the present invention comprises an engine with such common-rail injection system. In particular, this can be a diesel engine.

Furthermore, the present invention comprises a mobile implement with an engine according to the invention.

Also independent of the controller according to the invention, the present invention comprises a method for controlling a common-rail injection system which includes a plurality of fuel injectors, a common pressure line for the fuel injectors, a high-pressure pump for supplying the common pressure line with fuel, and a pressure sensor for determining the pressure in the common pressure line. According to the method of the invention data of the pressure sensor are evaluated, and from the pressure drop caused by an injection in the common fuel supply line the fuel quantity actually injected during this injection or a value derived therefrom is determined. Furthermore, the results of the evaluation are used to adapt the actuation of the fuel injectors. According to the invention it is provided that the determination of the actually injected fuel quantity or a value derived therefrom is effected by means of at least one test injection.

Preferably, the method according to the invention is effected such as has already been described above in detail with regard to the inventive configuration of the controller. In particular, the method according to the invention is effected by using a controller as it has been described above in detail.

Advantageously, the inventive controller for the common-rail injection system is configured such that the controller carries out all steps and activities in an automated way. In particular, a corresponding computer program can be provided for this purpose, which is stored in a memory of the controller and comprises commands for carrying out the method according to the invention or for implementing the controller according to the invention.

The present invention will now be explained in detail with reference to an exemplary embodiment and drawings.

DETAILED DESCRIPTION OF THE INVENTION

Figure 1:
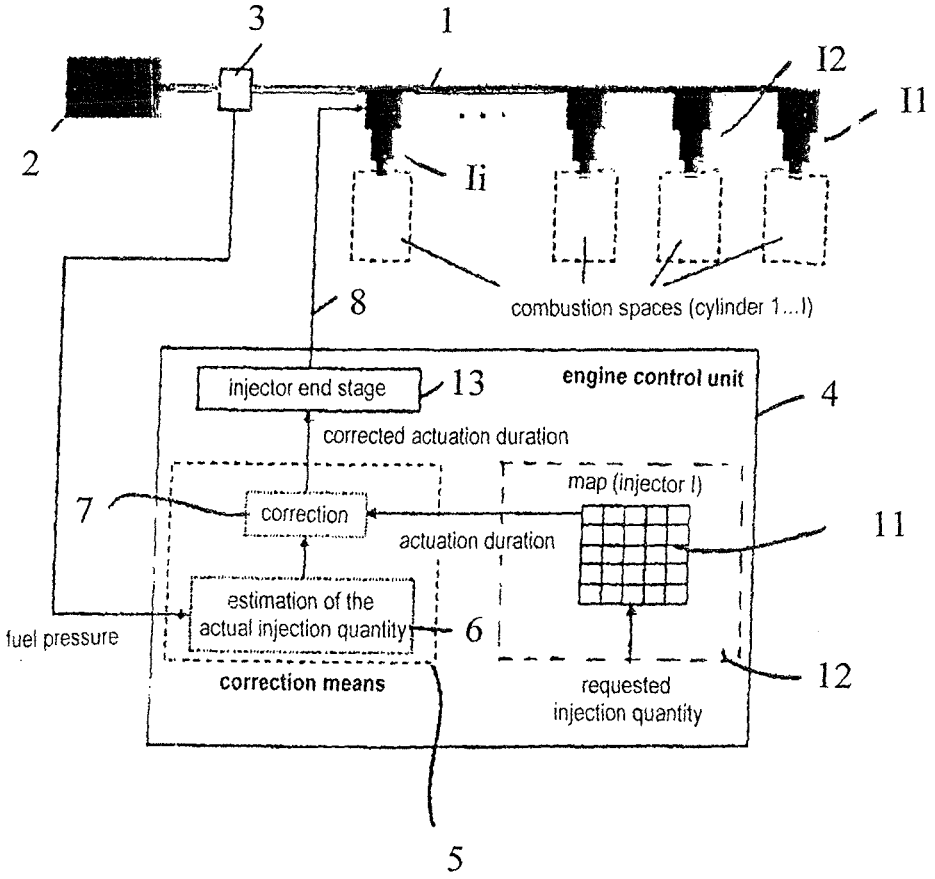
FIG. 1 shows an exemplary embodiment of an injection system according to the invention with an exemplary embodiment of an inventive controller.

FIG. 1 shows an exemplary embodiment of an injection system according to the invention with an inventive controller. The common-rail injection system includes a plurality of injectors I1, I2 to Ii, which are supplied with pressurized fuel by a common fuel supply line 1. There is provided a high-pressure pump 2 which supplies the common fuel supply line 1 with high pressure. Furthermore, there is provided a pressure sensor 3 for measuring the pressure in the common fuel supply line 1.

FIG. 1 furthermore shows a block diagram of an engine control unit 4 according to the invention. The same initially contains a conventional control block 12 in which the duration of actuation for the respective injector is determined from the injection quantity requested for the engine operation with reference to maps. The requested injection quantity serving as input for the control block 12 is determined for example on the basis of engine operating conditions and/or control signals generated by the driver, in particular from the desired speed and/or the desired torque of the engine. The control block 12 can comprise either a common map 11 for all injectors or injector-individual maps.

The engine control unit 4 furthermore comprises a controller 5 according to the invention, which in a determination unit 6 determines the actually injected fuel quantity from the fuel pressure determined by the sensor 3 during a test injection. In an adaption unit 7 one or more correction factors are formed from a comparison of the target injection quantity and the actual injection quantity during the test injection, by which the duration of actuation determined by the control block 12 is corrected. The corrected duration of actuation then is supplied to the injector end stage 13, which generates the immediate electrical actuation signals for the injectors, which are transmitted to the same via a control line 8.

The exemplary embodiment of the controller according to the invention as shown in FIG. 1 will now be described in detail below.

The precise dosage of the injected fuel quantity plays an essential role with regard to the subsequent combustion and the exhaust gases generated thereby. Due to production-related component variances of the fuel injectors and aging phenomena during the engine operation, the same must be calibrated while the engine is running.

Fuel injectors are subject to production-related component variances which impair the dosing accuracy. The loading of the fuel system with higher and higher system pressures leads to additional component drifts, which entail negative effects on the emission behavior and the efficiency of the engine. To counteract these deviations, a correction of the injector actuation is necessary, in order to ensure stable running of the engine.

This means that deviations or drifts in the actually injected fuel quantity must be detected, quantified and compensated by a corresponding adaptation of the injector actuation.

For this purpose, the present invention provides a strategy and a controller for the injector diagnosis and calibration. Since an additional expenditure of engine sensors, e.g. additional acceleration or pressure sensors, should be avoided as far as possible, the exemplary embodiment relies on the signal of the common-rail pressure sensor installed as standard in the high-pressure pump. The control hence is based on the evaluation of the pressure sensor signal at the high-pressure pump.

The controller (5) according to the invention, which can be integrated into the engine control unit (4), substantially consists of two parts, see the exemplary embodiment shown in FIG. 1:

- A determination unit (6) for estimating the actually injected fuel quantity. This unit consists of a method which estimates the actually injected fuel quantity per injector on the basis of the respective pressure drop in the fuel supply line. The pressure drop is determined from the pressure sensor signal of the fuel supply line.
- An adaption unit (7), which carries out a target/actual comparison on the basis of the injection quantity estimation and adapts the injector actuation on the basis of the result.

Figure 2:
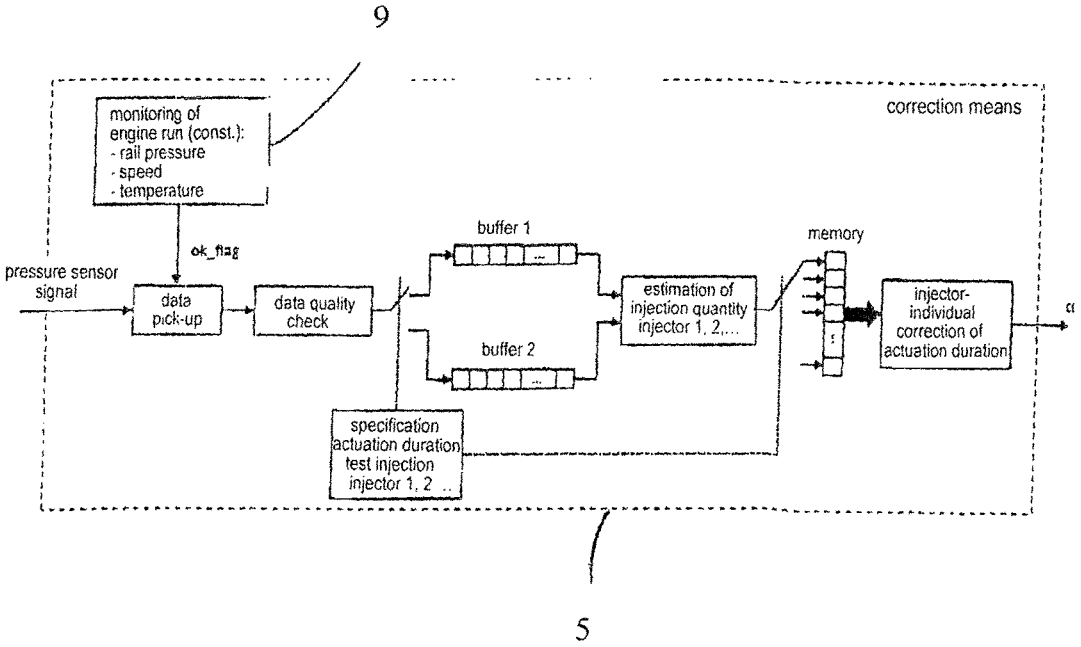
FIG. 2 shows a flow diagram of an exemplary embodiment of a method according to the invention as it proceeds in an inventive controller.

By means of the controller according to the invention, deviations or inaccuracies in the injected fuel quantity can be compensated, which are due to the following reasons:

- inaccuracies due to manufacturing tolerances
- aging phenomena or wear
- nozzle coking FIG. 2 shows the block circuit diagram of the controller for an individual injector of the common-rail system. The same carries out test injections (10), by which the injected fuel quantity can be estimated for the respective injector.

This is effected in a static operating point of the internal combustion engine, i.e. with constant duration of injector actuation and constant fuel pressure. On the basis of this estimation an injector-individual correction of the duration of actuation is determined, by means of which the actuation map is adapted. The actually injected fuel quantity can be determined in several specified static operating points of the engine, in order to thereupon carry out a target/actual comparison.

The controller operates as follows:

- A monitoring unit (9) sets an ok_flag to 1, as soon as the engine is in an operating condition favorable for carrying out the injection correction. If this is the case, a test injection (10) is carried out in cylinder 1, 2, . . . in a defined, fixed time interval with a specified duration of actuation at constant fuel pressure.
- After a data quality check, above all an outlier handling for identifying poor measurements, the signal course is temporarily stored in buffer 1.
- Directly thereafter, the pressure sensor history is recorded in the same time interval without injection. This signal course serves as reference and is stored in buffer 2.
- When both buffers are filled, the estimation of the actually injected fuel quantity is carried out and the result is stored temporarily.
- On the basis of the estimation results for different test injections, an injector-individual correction of the duration of actuation is determined.

Input quantities of the monitoring unit (9) include the injection quantity for the normal engine operation and/or the temperature of the fuel. It is checked whether the variation of these quantities lies below a specified threshold, i.e. whether the engine operation is changed and/or the fuel injection system is in a stable state. The speed of the internal combustion engine serves as further input quantity. It is checked whether the same lies below a specified threshold, since at low speeds the period available for the test injection is longer than at high speeds. Preferably, the test operation therefore is effected in the idle mode of the engine.

The estimation of the injection quantity is based on the determination of the pressure drop obtained in the common rail due to the fuel injection. The same can be determined from the two pressure profiles of buffer 1 and buffer 2.

The set-up for determining the actually injected fuel mass is supplied by equation (1), $$\Delta m = -V_0 \cdot \beta \cdot \rho \cdot \Delta p \tag{1}$$

with $$\Delta p(t) = p_{ref}(t) - p(t) \tag{2}$$

$V_0$ herein represents the known raw volume of the high-pressure side of the injection system, $\beta$ the compressibility coefficient and $\rho$ the fuel density at the system pressure p and the temperature T.

Figure 3:
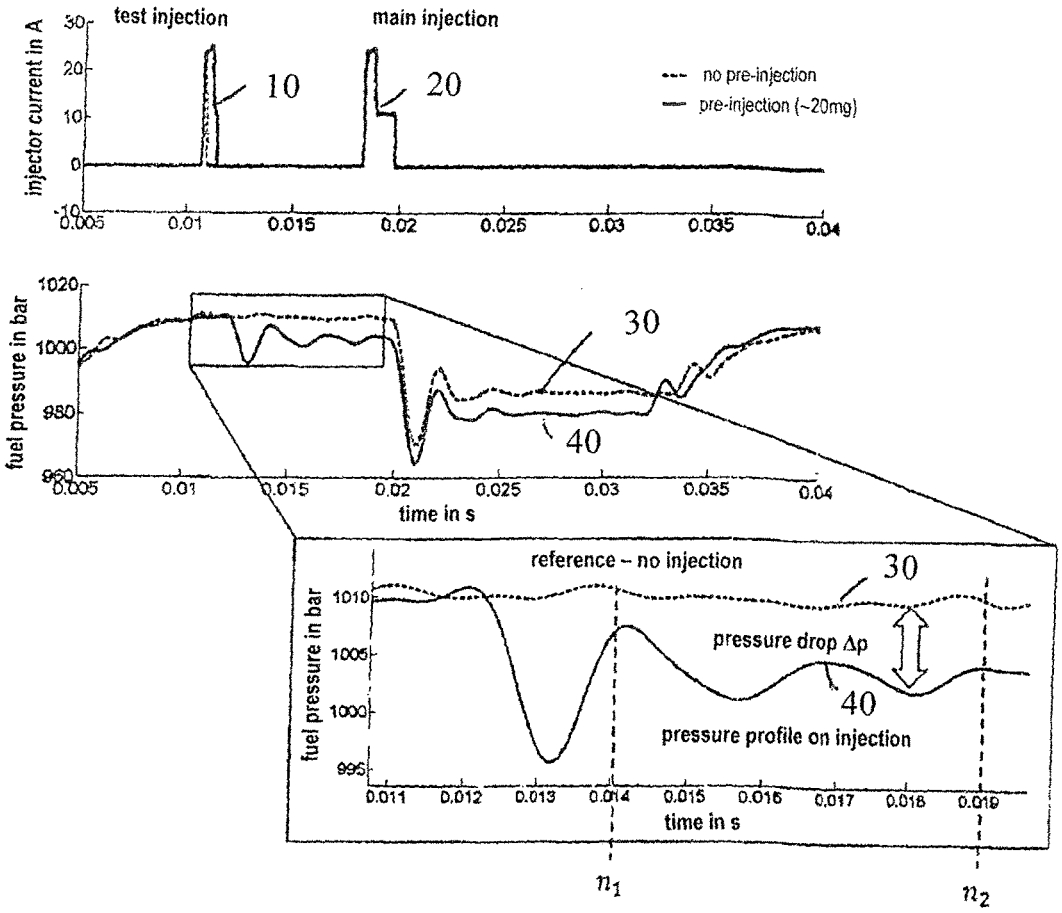
FIG. 3 shows two diagrams which illustrate the time profile of a test injection used according to the invention and of the test pressure profile caused thereby in the common fuel supply line as compared to a reference pressure profile without test injection.

The pressure difference $\Delta p$ can be determined by forming the average from a plurality of measurements. In FIG. 3 the mean of the family of curves of ten (10) measurements of the course of the pressure sensor signal is shown in a continuous line as test signal course (40) with a constant test injection (10), here a pre-injection each with constant duration of actuation. In a broken line, the mean of the family of curves of ten (10) measurements of the signal course is shown as reference signal course (30), at which no test injection (10) was made. From these measurements, the actually injected fuel mass can be determined.

In the exemplary embodiment, the measurement pick-up is triggered by the actuation pulse of the fuel injector for triggering the test injection (10). The same represents triggering by hardware, which triggers the measurement pick-up by the A/D converter provided for measurement pick-up.

FIG. 3 also shows a small deflection in the actuation signal during the generation of the reference measurement signal. This is a very short duration of actuation of the fuel injector, in which no injection occurs. This means that this short excitation is not sufficient to open the injector. This very short actuation pulse is used to trigger the measurement pick-up for determining the reference measurement signal.

The pressure difference $\Delta p$ then is obtained as difference between the test pressure signal 40 and the reference pressure signal 30, wherein this difference is determined in a previously defined evaluation interval 50 which depends on the start of actuation, i.e. the start of energization of the injector.

Figure 4:
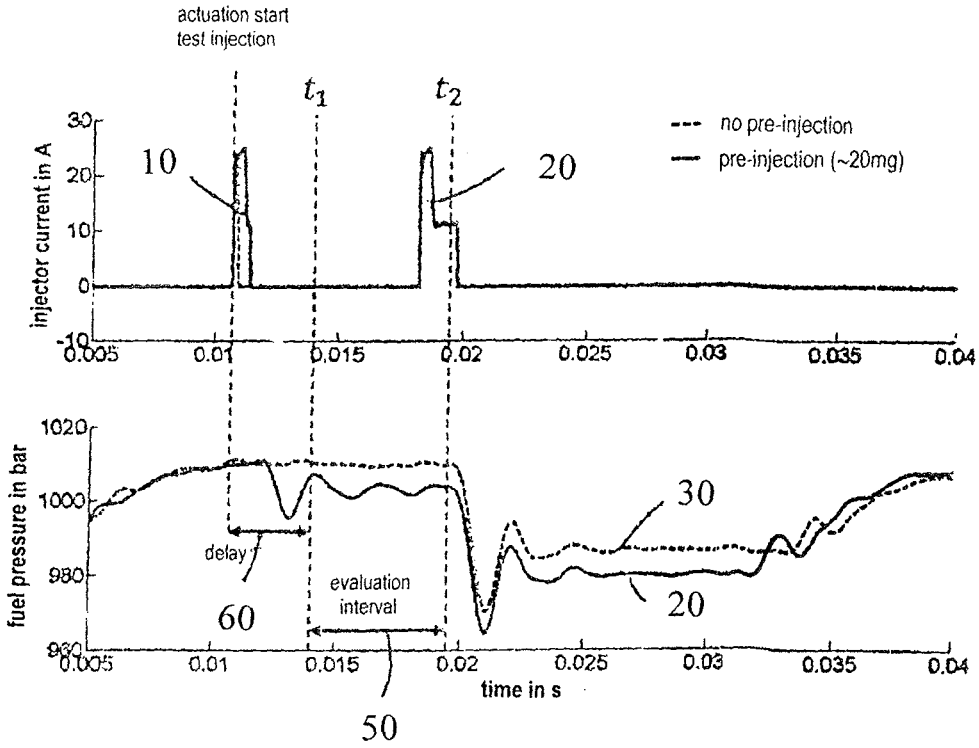
FIG. 4 shows a representation of an evaluation interval chosen according to a first alternative for the pressure profiles shown in FIG. 3.

The determination of the measurement values is effected in a fixed time interval $[t_1,t_2]$ (evaluation interval), which is shown in FIG. 4. The evaluation interval (50) depends on the actuation time, e.g. on the actuation start or end of the test injection (10) and accounts for the time delay (60) between this actuation time and the pressure drop triggered by the test injection. Furthermore, the evaluation interval should be chosen such that the pressure signal within the evaluation interval (50) does not depend on the starting of the high-pressure pump or other injections such as e.g. the main injection (20). Alternatively or in addition, a test injection also might be effected after the main injection (20).

The evaluation interval can depend on the injection duration and/or quantity of the test injection (10). In the exemplary embodiment, the evaluation interval has been chosen such that it will start only after the first attenuated half-oscillation of the pressure signal (40) and preferably after the first full oscillation of the pressure signal (40), in order to measure only the static part of the pressure drop, as far as possible.

The pressure signal represents a superposition of the signals generated by the main injections, the operation of the high-pressure pump and the test injections. A certain temporal distance between the test injection and the preceding operation of the high-pressure pump or the preceding main injection therefore is necessary. Preferably, the test injection should be effected only after one or two attenuated full oscillations caused by a main injection and/or the operation of the high-pressure pump.

In the exemplary embodiment, the operation of the high-pressure pump (2), the main injection (20) and the initiation of the test injection (10) each are effected at specified points in time and/or crankshaft angles within the engine cycle. It can thereby be ensured that the test injection is effected with a sufficient temporal distance to the preceding and the succeeding events.

To avoid too short and too long injection times, which would lead to a high inaccuracy in the measurement or too large a temporal proximity between main and test injection, the injection quantities of the test injections in the exemplary embodiment are chosen between 4 mg and 5 mg, furthermore preferably below 50 mg.

In the case of too high speeds and/or an engine with many cylinders only a very short time window between the operation of the high-pressure pump and the main injection is available for the test injection and the succeeding measurement phase. To increase this time interval, the operation of the high-pressure pump can be shifted towards early, when the test injection is effected as pre-injection, or towards late, when the test injection is effected as post-injection. Such shifting can be made either only in those operating phases in which test injections are made or generally. Possibly, the operation of the high-pressure pump and the main injection even can be effected at the same time, so that the time window for the test injection becomes maximal.

Alternatively or in addition, in an operating phase in which test injections are made, individual main injections and/or operating phases of the high-pressure pump can be omitted. The period available for the test injection also is expanded thereby.

According to the present invention, the actual injection quantity now is calculated from the pressure difference caused by the test injection. In the exemplary embodiment, the calculation of the pressure difference Δp is effected from a time-discrete pressure profile p(n) and the reference pressure profile $p_{ref}(n)$, with n as discrete time index, by calculation of the arithmetic mean value in a previously defined discrete time interval $[n_1,n_2]$ which depends on the start of actuation, i.e. the start of energization of the injector.

The signal evaluation corresponds to the calculation of the pressure drop according to equation (3).

$$\Delta p = \frac{1}{n_2 - n_1 + 1} \cdot \sum_{n=n_1}^{n_2} (p_{ref}(n) - p(n)) \tag{3}$$

On the basis of the determined pressure drop from equation (3), the actually injected fuel mass is determined by means of equation (1).

The process of the estimation of the actually injected fuel mass by means of the indicated procedure is repeated for several durations of actuation at a specified constant fuel pressure.

The estimated fuel quantities are stored temporarily for each injector, see FIG. 2. From these data, the injector-individual correction values α for the duration of actuation thereupon are determined by means of a comparison with the target fuel quantities.

Figure 5:
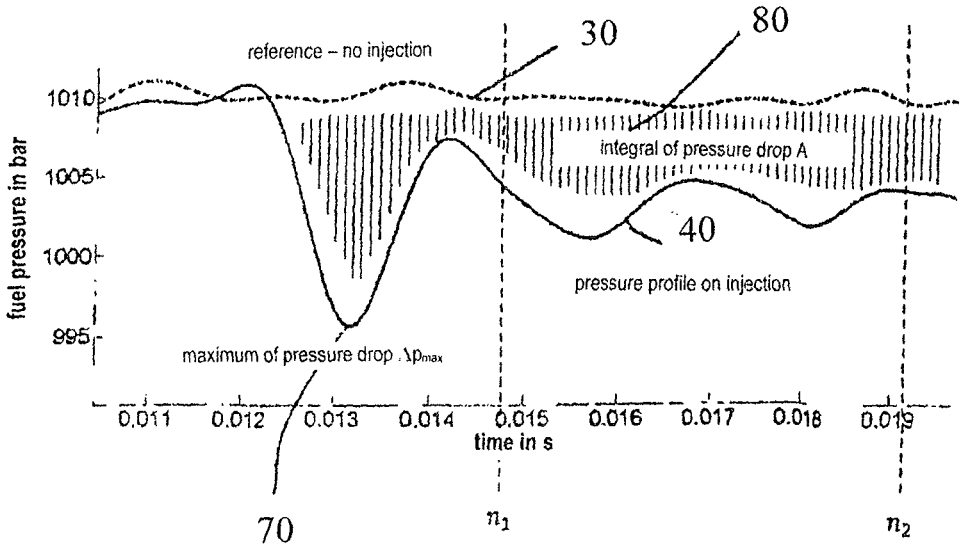
FIG. 5 shows a representation of two alternative measurement times or evaluation intervals for the pressure profiles shown in FIG. 3.

As an alternative to averaging as indicated in equation (3), the integral of the pressure drop A can be determined, which in the time-discrete case corresponds to the sum $$A=\Sigma_{n=n_1}^{n2}\Delta p(n) \tag{5}$$

and hence the area between the two curves, see FIG. 5.

Furthermore, the maximum $\Delta p_{max}$ of the pressure drop also can be determined, which likewise is shown in FIG. 5.

In the two last-mentioned cases, the characterization of the actual state of the respective injector is not effected by means of the injection quantity, but by means of the auxiliary quantities A or $\Delta p_{max}$ by which the injector drift is detected and compensated via injector-individual correction values α for the duration of actuation.

The corrected duration of actuation corresponds to a function of the respective duration of actuation TOC and the injector-individual correction α.

$$TOC_{corrected}=f(TOC,\alpha) \tag{4}$$

When the injector-individual correction values α as shown above are determined for several different durations of actuation of the test injection, α can be a function of the duration of actuation α(TOC).

Furthermore, the injector-individual correction values α can be determined in several specified static operating points of the engine, in particular at different system pressures p. In this case, the injector-individual correction values α are represented as a map. Alternatively, a determination is possible at only one static operating point of the engine, in particular at a system pressure p, wherein the correction values for other static operating points of the engine, in particular other system pressures p, are extrapolated from the correction values thus determined.

Alternatively, the correction values also can be utilized to correct the injector-individual maps (11) stored in the controller for determining the duration of actuation TOC from the desired injection quantity.

The essential aspects of the inventive controller for compensating deviations and drifts in the injection quantity for direct injection systems on the basis of the injection-related pressure drop in the fuel supply line will again be represented below independent of the exemplary embodiment shown above:

i. The controller according to the invention determines the actually injected fuel quantity from the pressure drop in the fuel supply line in a fixed time interval $[t_1,t_2]$ (evaluation interval).

ii. According to the invention, a test injection is carried out, if the unit is in a favorable operating point (for this purpose, the engine operation can be monitored).

iii. The pressure profiles for M test injections with constant duration of actuation and specified constant fuel pressure are recorded and averaged.

iv. By comparison with the reference recording (M pressure profiles without test injection), the effective pressure drop Δp is determined.

v. By means of equations (1) and (2), the actually injected fuel mass is determined from the recorded pressure profiles (no auxiliary quantity, but the fuel mass which can be interpreted directly).

vi. For recording the pressure sensor signals no additional sensor is necessary, i.e. no constructive change to the injection system. No additional sensors, throttles or hydraulic accumulators are necessary for realizing the injection quantity estimation. The injection quantity purely is determined from the sensor signal which is supplied by the pressure sensor installed as standard.

vii. By means of the determined actual injection quantities in various operating points, an injector-individual actuation correction is determined, which is applied for future injections.

viii. The injection quantity is determined for each of the installed injectors individually and independently.

ix. The injection quantity estimation is carried out on the basis of a test injection, i.e. a pre- or post-injection, and can be carried out in normal engine operation.

x. The controller according to the invention can be integrated on an engine control unit. As an alternative to iv., the integral of the pressure drop A can be determined, and/or the maximum $\Delta p_{max}$ of the pressure drop.

xi. If the proceeding is as in item ix., the characterization of the actual state of the respective injector is not effected by means of the injection quantity, but by means of the auxiliary quantities A or Δpmax by which the injector drift is detected and compensated.

Particularly preferably, the essential aspects set forth above are realized such as has been described in general in the beginning and more detailed above in the exemplary embodiment.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A controller for a common-rail injection system, which includes a plurality of fuel injectors, a common fuel supply line for the fuel injectors, a high-pressure pump for supplying the common fuel supply line with fuel, and a pressure sensor for determining the pressure in the common fuel supply line, comprising:

a determination unit configured to evaluate data of the pressure sensor during an evaluation interval chosen, depending on an actuation start time or an actuation end time of at least one test injection in the common fuel supply line made in addition to normal injections in the common fuel supply line for engine operation, to start after an attenuated half oscillation of a pressure signal caused by the at least one test injection and to end during a normal injection in the common fuel supply line for engine operation, and, from a pressure drop occurring during the evaluation interval caused by the at least one test injection in the common fuel supply line made in addition to the normal injections, to determine a fuel quantity actually injected during this injection or a value derived therefrom, and an adaption unit configured to use the results of the determination unit in order to adapt the actuation of the fuel injectors, wherein the determination unit is further configured to carry out the at least one test injection by way of which the actually injected fuel quantity or the value derived therefrom is determined.

2. The controller according to claim 1, wherein the determination unit is further configured to determine a reference measurement signal of the pressure sensor without the test injection and a test measurement signal of the pressure sensor when the test injection has been made, and wherein for determining the pressure drop caused by the injection, the determination unit is configured to employ the difference between the reference measurement signal and the test measurement signal.

3. The controller according to claim 2, wherein the determination unit is further configured to determine the reference measurement signal and the test measurement signal in the same time interval with respect to an engine cycle and/or under injection and/or engine operating conditions that are identical except for the test injection.

4. The controller according to claim 1, wherein the determination unit is configured to carry out several test injections and for determining the actually injected fuel quantity or a value derived therefrom forms a mean value, wherein the determination unit is configured to perform the several test injections at least one of in the same time interval with respect to the engine cycle, under identical injection, engine operating conditions, or injection and engine operating conditions, with at least one of identical durations of actuation, injection quantities of the fuel injector, and identical actuation signals, and wherein the determination unit is configured to determine both the test measurement signal and the reference measurement signal several times.

5. The controller according to claim 1, wherein the determination unit is configured to perform the at least one test injection at least one of in a specified time interval, with a specified duration of actuation, and/or injection quantity of the fuel injector, and with a specified actuation signal, and wherein at least one of the specified time interval, the specified duration of actuation, the injection quantity of the fuel injector, and the specified actuation signal is independent of the injection time and/or injection quantity desired for the normal engine operation.

6. The controller according to claim 1, wherein the at least one test injection is a pre-injection or a post-injection effected before or after a main injection.

7. The controller according to claim 1, further comprising a monitoring unit configured to monitor engine operation, which is connected with the determination unit such that determination of the actually injected fuel quantity or a value derived therefrom is carried out by the determination unit at constant pressure and/or constant temperature in the common fuel supply line, constant speed and/or constant fuel injection quantity for the normal engine operation, wherein the determination is effected over several engine cycles or initiation of the determination of the actually injected fuel quantity or a value derived therefrom is effected by the determination unit in response to an inquiry as to whether the speed of the engine operates below a certain speed threshold, and wherein the determination is effected in the idling mode of the internal combustion engine.

8. The controller according to claim 1, wherein several measurement values are averaged within the evaluation interval, and wherein the test injection is effected at a time which lies after the first attenuated half oscillation of the pressure signal caused by at least one of a main injection and the operation of the pump.

9. The controller according to claim 1, wherein the determination and the adaption are effected individually for each fuel injector.

10. The controller according to claim 1, wherein the determination and the adaption are effected for several different pressures in the common fuel supply line, for several different durations of actuation and/or injection quantities of the fuel injector during test injections, or both.

11. The controller according to claim 1, wherein the determination of the actually injected fuel quantity or a value derived therefrom by the determination unit is coordinated with an actuation circuit of the high-pressure pump, wherein between a start of the test injection and an end of an associated measurement phase, no operation of the high-pressure pump is effected, and wherein on determination of a reference measurement signal of the pressure sensor without test injection, no operation of the high-pressure pump is effected during a corresponding reference period.

12. The controller according to claim 1, wherein operation of the high-pressure pump is, each initiation of the test injection within an engine cycle is, or both the operation and the initiation are effected at specified points in time and/or crankshaft angles, wherein, in an operating phase in which test injections are made, the operation of the high-pressure pump is shifted towards early or towards late, wherein the test injection is effected in a prolonged interval between the operation of the high-pressure pump and a main injection or in a prolonged interval between the main injection and the operation of the high-pressure pump, and wherein in an operating phase in which test injections are made, individual main injections and/or operating phases of the high-pressure pump are omitted.

13. The controller according to claim 8, wherein the evaluation interval is chosen such that it starts after a first attenuated full oscillation of the pressure signal caused by the test injection, and wherein the test injection is effected at a time which lies after the first attenuated full oscillation of the pressure signal caused by at least one of the main injection and the operation of the pump.

14. The controller according to claim 10, wherein the injection quantity of the test injection lies between 2 mg and 80 mg.

15. The controller according to claim 14, wherein the injection quantity of the test injection lies between 5 mg and 50 mg.

16. The controller according to claim 10, wherein the number of the different durations of actuation and/or the number of injection quantities lies between 2 and 20.

17. The controller according to claim 16, wherein the number of the different durations of actuation and/or the number of injection quantities lies between 4 and 10.

18. A common-rail injection system comprising:

a plurality of fuel injectors, a common fuel supply line for the fuel injectors, a high-pressure pump for supplying the common fuel supply line with fuel, a pressure sensor for determining a pressure in the common fuel supply line, and a controller having a determination unit configured to evaluate data of the pressure sensor during an evaluation interval chosen, depending on an actuation start time or an actuation end time of at least one test injection in the common fuel supply line made in addition to normal injections in the common fuel supply line for engine operation, to start after an attenuated half oscillation of a pressure signal caused by the at least one test injection and to end during a normal injection in the common fuel supply line for engine operation, and, from a pressure drop occurring during the evaluation interval caused by the at least one test injection in the common fuel supply line in addition to the normal injections, determines a fuel quantity actually injected during this injection or a value derived therefrom, and an adaption unit configured to use the results of the determination unit in order to adapt the actuation of the fuel injectors, wherein the determination unit is further configured to carry out at least one test injection by way of which the actually injected fuel quantity or the value derived therefrom is determined.

19. An engine comprising a common-rail injection system according to claim 18.

20. A method for actuating a common-rail injection system which includes a plurality of fuel injectors, a common fuel supply line for the fuel injectors, a high-pressure pump for supplying the common fuel supply line with fuel, a pressure sensor for determining a pressure in the common fuel supply line using a controller having a determination unit, and an adaption unit, the method comprising:

evaluating data of the pressure sensor with the determination unit during an evaluation interval chosen, depending on an actuation start time or an actuation end time of at least one test injection in the common fuel supply line made in addition to normal injections in the common fuel supply line for engine operation, to start after an attenuated half oscillation of a pressure signal caused by the at least one test injection and to end during a normal injection in the common fuel supply line for engine operation, determining, with the determination unit, a fuel quantity actually injected during an injection or a value derived therefrom from a pressure drop occurring during the evaluation interval caused by way of the at least one test injection carried out by the determination unit in the common fuel supply line in addition to the normal injections in the common fuel supply line for engine operation, and adapting, with the adaption unit, actuation of the fuel injectors using results of the data evaluation.

* * * * *